US007121933B2

(12) United States Patent
Kim

(10) Patent No.: US 7,121,933 B2
(45) Date of Patent: Oct. 17, 2006

(54) CHEMICAL MECHANICAL POLISHING APPARATUS

(75) Inventor: Hwal Pyo Kim, Incheon (KR)

(73) Assignee: Dongbu Electronics Co., Ltd., Seoul (KR)

( * ) Notice: Subject to any disclaimer, the term of this patent is extended or adjusted under 35 U.S.C. 154(b) by 0 days.

(21) Appl. No.: 10/997,270

(22) Filed: Nov. 24, 2004

(65) Prior Publication Data

US 2005/0113010 A1 May 26, 2005

(30) Foreign Application Priority Data

Nov. 26, 2003 (KR) ..... 10-2003-0084521

(51) Int. Cl.
*B24B 5/00* (2006.01)

(52) U.S. Cl. ..... 451/285; 451/495; 451/504

(58) Field of Classification Search ..... 451/66, 451/67, 41, 57, 504, 490, 495, 505, 527, 451/530
See application file for complete search history.

(56) References Cited

U.S. PATENT DOCUMENTS

| | | | | |
|---|---|---|---|---|
| 5,800,248 | A * | 9/1998 | Pant et al. | 451/41 |
| 5,931,719 | A * | 8/1999 | Nagahara et al. | 451/41 |
| 6,056,631 | A | 5/2000 | Brown et al. | 451/288 |
| 6,179,956 | B1 | 1/2001 | Nagahara et al. | 156/345 |
| 6,293,845 | B1 | 9/2001 | Clark-Phelps | 451/5 |
| 6,913,518 | B1 * | 7/2005 | Chen et al. | 451/41 |
| 2002/0151256 | A1 * | 10/2002 | Taylor et al. | 451/41 |
| 2005/0272348 | A1 * | 12/2005 | Min et al. | 451/11 |
| 2006/0094341 | A1 * | 5/2006 | Schneider et al. | 451/41 |

* cited by examiner

*Primary Examiner*—Jacob K. Ackun, Jr.
(74) *Attorney, Agent, or Firm*—Andrew D. Fortney

(57) ABSTRACT

Disclosed is a chemical mechanical polishing apparatus for polishing a surface of a wafer using a mechanical friction as well as a chemical polishing agent. The chemical mechanical polishing apparatus includes a polishing head for absorbing a wafer and a polishing means for polishing the wafer. The polishing apparatus may include a platen composed of at least three segments formed in conformity with polishing zones, a polishing pad provided on each of the segments, and a support for supporting the segments such that the segments are separately adjustable in the height depending on the polishing zones and are rotatable.

11 Claims, 3 Drawing Sheets

CHEMICAL MECHANICAL POLISHING APPARATUS

TECHNICAL FIELD

The present disclosure relates to semiconductor processing and, more particularly, to a chemical mechanical polishing (CMP) apparatus.

BACKGROUND

Recently, due to the high integration level of semiconductor devices, semiconductor devices have been structured in multiple layers. Accordingly, a polishing process for planarizing layers of a semiconductor wafer is indispensably included in a fabrication process of the semiconductor devices. One known polishing process, CMP, is mainly being used.

The CMP process is a process for polishing a surface of a wafer coated with tungsten, oxide, etc., through the use of mechanical friction, as well as a chemical polishing agent. The mechanical portion of the CMP polishes a surface of a semiconductor wafer using friction between a polishing pad and the surface of the semiconductor wafer by rotating the wafer fixed on a rotating polishing head, with the wafer pressed against the polishing pad. The chemical portion of the CMP polishes the surface of the wafer using a slurry supplied between the polishing pad and the wafer as the chemical polishing agent.

This CMP process results in excellent planarity in a wide region as well as a narrow region. Accordingly, CMP is particularly adapted to the trend toward enlargement of wafer diameter.

Referring to FIG. 1, which illustrates a schematic configuration of a conventional CMP apparatus for performing the CMP process, the CMP apparatus generally includes a polishing station 110 and a polishing head assembly 120.

The polishing station 110 has a platen 114 on which a polishing pad 112 is placed. The polishing head assembly 120 includes a polishing head 122 for adsorbing a wafer W in a vacuum and an arm 124 connected to the polishing head 122. An actuator (not shown) loadings/unloadings the polishing head 122 on/from the polishing pad 112. The polishing station 110 may also utilize a vacuum supply unit (not shown), a compressed air supply unit (not shown), etc. In FIG. 1, reference numeral 126 denotes a slurry supply nozzle.

In the CMP process using the CMP apparatus as configured above, one conventional method for controlling uniformity of the wafer in order to secure a margin of depth of focus (DOF) in a photolithography process includes adjusting the number of turns of the platen and the polishing head. A pressure applied to the polishing head may also be adjusted in an attempt to achieve uniformity.

In addition, recently, there has been proposed a method for adjusting a pressure applied to the polishing head, such that different pressures are applied to different zones of the wafer for improving the uniformity of the wafer.

The above-mentioned conventional methods are disclosed in U.S. Pat. Nos. 6,056,631, 6,179,956, and 6,293,845.

However, when the wafer W is polished using the conventional CMP apparatus, a problem arises in that it is not easy to control the uniformity in the CMP process.

DETAILED DESCRIPTION

Disclosed herein are example chemical mechanical polishing apparatus for polishing a surface of a wafer using a mechanical friction, as well as a chemical polishing agent. In particular, FIG. 2 is a schematic diagram showing a configuration of an example CMP apparatus and FIG. 3 is a plan diagram of the platen of FIG. 2.

Figure 1:
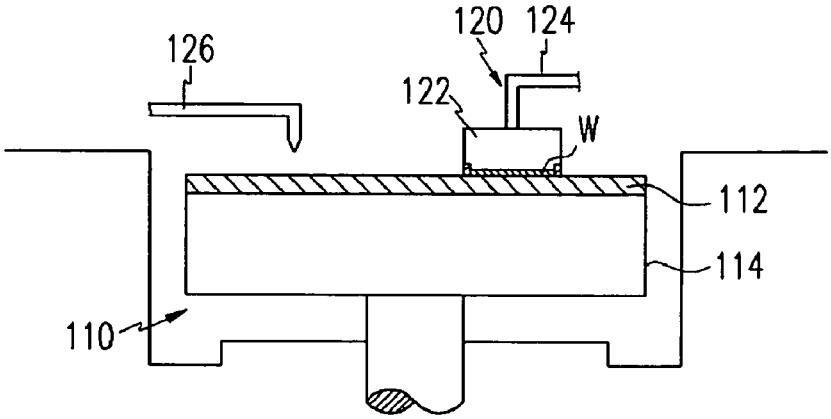
FIG. 1 is a schematic diagram showing a configuration of a conventional chemical mechanical polishing apparatus.
Figure 2:
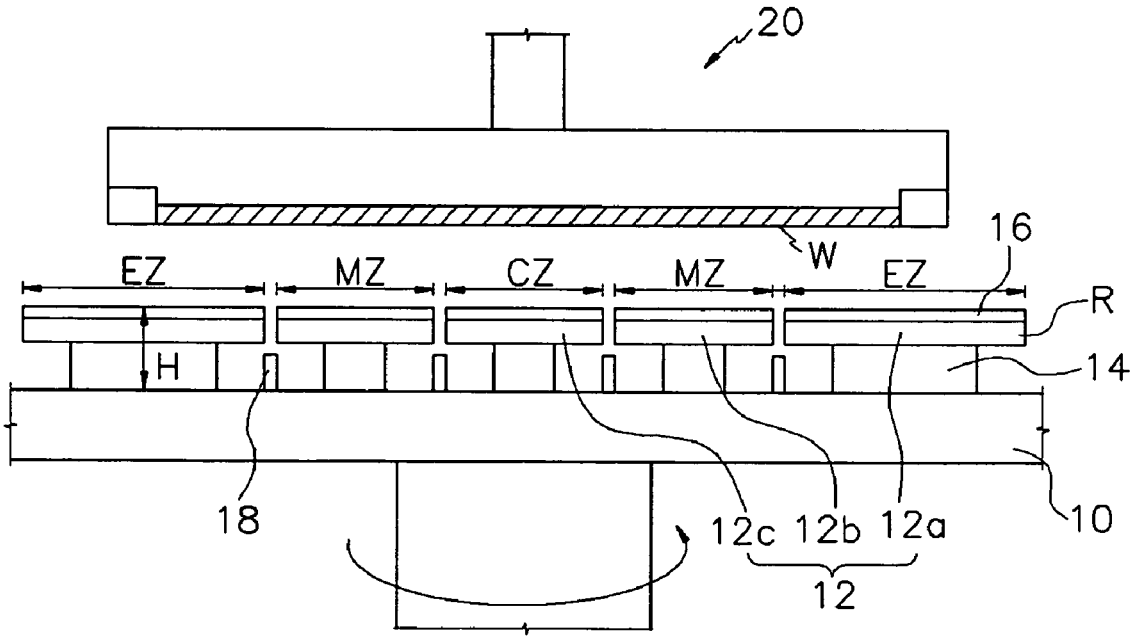
FIG. 2 is a schematic diagram showing a configuration of one example disclosed chemical mechanical polishing apparatus.

As shown in FIG. 2, the chemical mechanical polishing apparatus according to this example includes a support 10. On the support 10 is installed a platen 12 composed of a plurality of ring-shaped or circle-shaped segments 12*a*, 12*b*, and 12*c* formed in conformity with polishing zones, for example, an edge zone EZ, a center zone CZ, and a middle zone MZ. In such an arrangement, the center zone CZ is circularly shaped and the middle zone MZ and the edge zone EZ are ring shaped.

Figure 3:
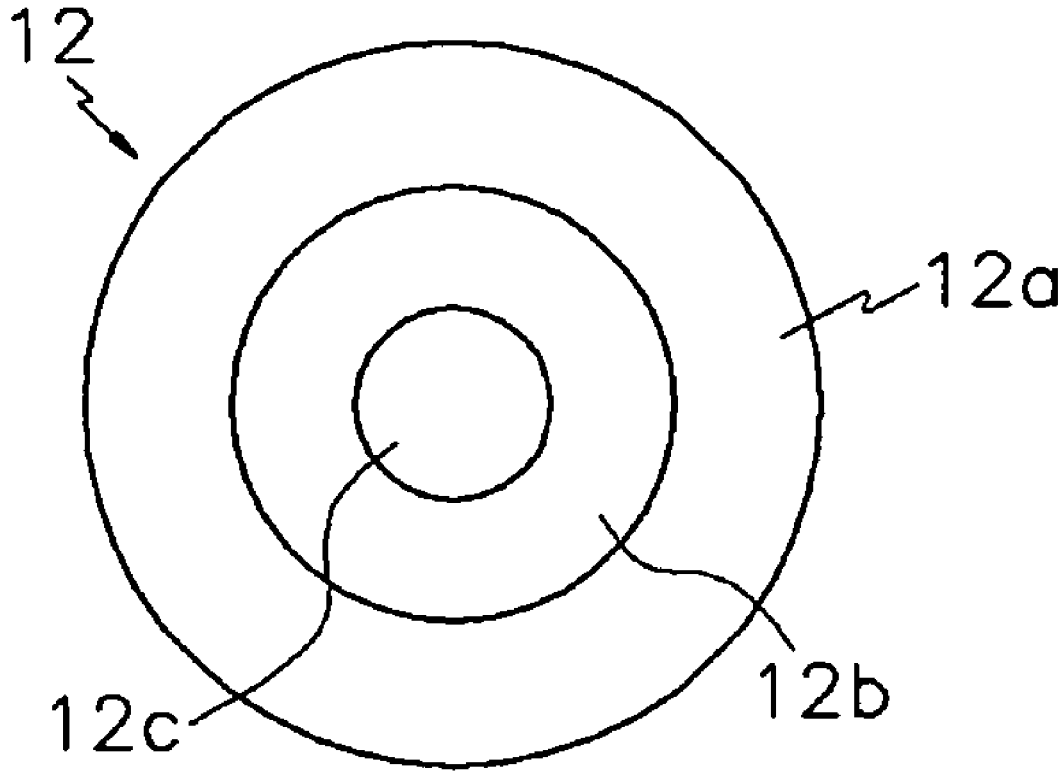
FIG. 3 is a plan diagram of the platen of FIG. 2.

Although the platen 12 is shown to be composed of three segments 12*a*, 12*b*, and 12*c* in FIGS. 2 and 3, the number of segments composing the platen 12 depends on the number of the polishing zones. Accordingly, it will be readily appreciated by those having ordinary skill in the art that any number of segments may be used to provide polishing zones.

In addition, the segment 12*a*, 12*b*, and 12*c* of the platen 12 are installed on the support 10 through rods 14 for adjustment of the height H of the segments 12*a*, 12*b*, and 12*c* formed in conformity with the polishing zones.

Figure 4:
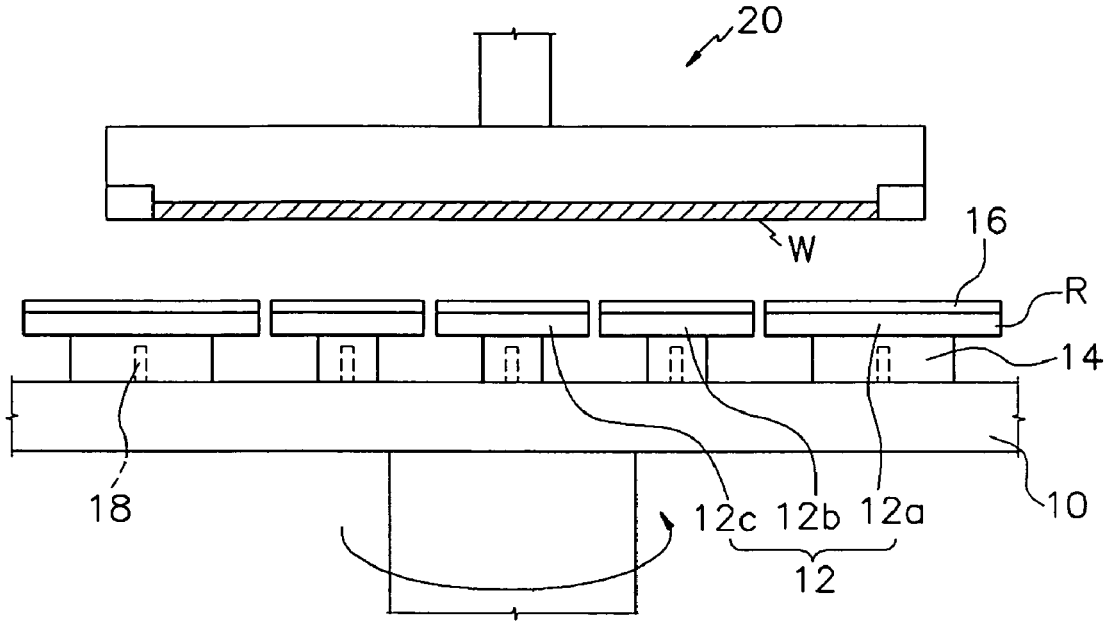
FIG. 4 is a schematic diagram showing a configuration of a second example disclosed chemical mechanical polishing apparatus.

The segments 12*a*, 12*b*, and 12*c* include corresponding polishing pads 16 for polishing the wafer W adhering closely to the polishing pads 16. In addition, between the segments 12*a*, 12*b*, and 12*c* are installed slurry supply nozzles 18 for supplying slurry for polishing of the wafer W. Alternatively, the slurry supply nozzles 18 may be installed to pass through centers of the segments 12*a*, 12*b*, and 12*c*, as shown in FIG. 4. In FIG. 4, holes formed to supply the slurry sprayed from the slurry supply nozzles for polishing the wafer W are not shown for the sake of brevity.

In addition, the support 10 for supporting the platen 12 is rotated with the preset number of turns by a motor (not shown).

In FIGS. 2 and 4, reference numeral 20 denotes a polishing head for absorbing and fixing the wafer.

With the configuration as described above, when the platen 12 is rotated with rotation of the support 10, a surface of the wafer W fixed to the polishing head 20 is polished. At this time, when the height H of each segment 12*a*, 12*b*, and 12*c* is adjusted using the rod 14 for adjustment of the height, a uniform pressure can be applied to the wafer W.

In addition, although not shown in detail, the polishing head 20 fixing the wafer W includes a membrane making a direct facial contact with the back side of the wafer W for applying a force to the back side of the wafer W by expanding by a pressure of compressed air supplied through fluid supply holes, a retainer ring for preventing the wafer W from deviating from the polishing head 20 in the course of the polishing process, and a carrier at which the membrane the retainer ring are installed and the fluid supply holes are formed. In this case, an arm for loading/unloading the polishing head to/from a polishing station is connected to the polishing head by an actuator (not shown).

As described above, the platen on which the polishing pads are installed is composed of the plurality segments, which are formed in conformity with the polishing zones and are installed on the support in such a manner that the height of the segments are adjustable. As is apparent from the above description, because a uniform pressure can be applied to the wafer by adjusting the height of the segments of the platen, polishing uniformity of the wafer can be significantly enhanced.

As disclosed above, in one example, there is provided a chemical mechanical polishing apparatus including a polishing head for absorbing a wafer and a polishing means for polishing the wafer. In such an arrangement, the polishing apparatus may include a platen composed of at least three segments formed in conformity with polishing zones, a polishing pad provided on each of the segments, and a support for supporting the segments such that the segments are separately adjustable in their height depending on the polishing zones and are rotatable.

In one arrangement, the segments of the platen may have a circular shape or a ring shape. Further, slurry supply nozzles may be provided between the segments or may pass through the segments.

Although certain apparatus constructed in accordance with the teachings of the invention have been described herein, the scope of coverage of this patent is not limited thereto. On the contrary, this patent covers every apparatus, method and article of manufacture fairly falling within the scope of the appended claims either literally or under the doctrine of equivalents;

This application makes reference to, incorporates the same herein, and claims all benefits accruing under 35 U.S.C. § 119 from an application for CHEMICAL MECHANICAL POLISHING APPARATUS filed in the Korean Industrial Property Office on Nov. 26, 2003, and there duly assigned Serial No. 10-2003-0084521.

What is claimed is:

1. A chemical mechanical polishing apparatus comprising:

a platen comprising a center polishing zone containing a rotatable circular segment with a first rod having an independently adjustable height, an edge polishing zone containing a first rotatable ring-shaped segment with a second rod having an independently adjustable height and a middle polishing zone between the edge polishing zone and the center polishing zone, containing a second rotatable ring-shaped segment with a third rod having an independently adjustable height, and a polishing pad on the platen.

2. A chemical mechanical polishing apparatus as defined by claim 1, further comprising slurry supply nozzles between the segments.

3. A chemical mechanical polishing apparatus as defined by claim 1, further comprising slurry supply nozzles passing through the center of the segments.

4. A chemical mechanical polishing apparatus as defined by claim 3, wherein the slurry is dispensed through holes in the polishing pad.

5. A chemical mechanical polishing apparatus as defined by claim 1, further comprising a polishing head.

6. A chemical mechanical polishing apparatus as defined by claim 5, wherein the polishing head comprises a membrane which contacts a backside of a wafer.

7. A chemical mechanical polishing apparatus as defined by claim 6, wherein the membrane is adapted to apply a force to the backside of the wafer.

8. A chemical mechanical polishing apparatus as defined by claim 1, further comprising a support under the platen.

9. A chemical mechanical polishing apparatus as defined by claim 1, wherein the polishing pad comprises separate zone polishing pads on each segment.

10. A chemical mechanical polishing apparatus as defined by claim 1, wherein the independently adjustable heights of the segments allow applying a uniform pressure to a surface of a wafer.

11. A chemical mechanical polishing apparatus as defined by claim 5, further comprising fluid supply holes in the polishing head to supply compressed air to a side of the membrane.

* * * * *